US007992833B1

(12) United States Patent
Goodman et al.

(10) Patent No.: US 7,992,833 B1
(45) Date of Patent: Aug. 9, 2011

(54) ADJUSTABLE HANGER DEVICE

(75) Inventors: Sheldon H. Goodman, Solon, OH (US); Omer I. Sazir, Cleveland, OH (US)

(73) Assignee: Spectrum Diversified Designs, Inc., Streetsboro, OH (US)

( * ) Notice: Subject to any disclaimer, the term of this patent is extended or adjusted under 35 U.S.C. 154(b) by 446 days.

(21) Appl. No.: 12/030,888

(22) Filed: Feb. 14, 2008

(51) Int. Cl.
*A47F 5/00* (2006.01)

(52) U.S. Cl. ..... 248/298.1; 248/307; 248/339

(58) Field of Classification Search ..... 248/304, 248/301, 307, 339, 690, 495, 496, 497, 298.1, 248/223.41, 225.11, 225.21, 224.8; 223/DIG. 4; 24/527, 528; 211/113, 118, 119.004, 175
See application file for complete search history.

(56) References Cited

U.S. PATENT DOCUMENTS

| | | | | |
|---|---|---|---|---|
| D273,445 | S | 4/1984 | Lohman | |
| D291,630 | S | 9/1987 | Chap | |
| D300,406 | S | 3/1989 | Bordian | |
| 4,872,224 | A | 10/1989 | Grimes et al. | |
| 4,984,722 | A | 1/1991 | Moore | |
| D322,361 | S | 12/1991 | Goodman et al. | |
| D336,842 | S | 6/1993 | Hampshire | |
| D342,889 | S | 1/1994 | Adams | |
| 5,316,256 | A * | 5/1994 | Siebenaler et al. | 248/453 |
| D349,447 | S | 8/1994 | Daniller | |
| D360,355 | S | 7/1995 | Adams | |
| D360,572 | S | 7/1995 | Adams | |
| D377,309 | S | 1/1997 | Hofman | |
| 5,738,319 | A * | 4/1998 | Grassi | 248/215 |
| D394,601 | S | 5/1998 | Mesna et al. | |
| 5,779,206 | A * | 7/1998 | Harris et al. | 248/214 |
| 5,803,422 | A | 9/1998 | Buehler | |
| D429,999 | S | 8/2000 | Swolsky et al. | |
| D445,669 | S | 7/2001 | Goodman et al. | |
| 6,267,257 | B1 | 7/2001 | DeBruyn | |
| 6,302,365 | B1 | 10/2001 | Catanzarite et al. | |
| 6,364,260 | B1 | 4/2002 | Lorincz et al. | |
| D456,695 | S | 5/2002 | Goodman et al. | |
| D482,600 | S | 11/2003 | Dretzka | |
| D483,655 | S | 12/2003 | Dretzka | |
| D491,791 | S | 6/2004 | Snell | |
| 6,749,165 | B2 | 6/2004 | Immerman | |
| D494,047 | S | 8/2004 | Klein et al. | |
| 6,814,335 | B2 | 11/2004 | Immerman | |
| 6,857,608 | B2 * | 2/2005 | Avinger | 248/215 |
| D533,445 | S * | 12/2006 | Janzen | D8/380 |
| D540,659 | S | 4/2007 | Schmidt | |
| 7,234,671 | B2 * | 6/2007 | Avinger | 248/215 |
| D557,120 | S | 12/2007 | Snell | |
| D563,109 | S | 3/2008 | Krumpe et al. | |
| D564,243 | S | 3/2008 | Zhang | |
| 2003/0173483 | A1 * | 9/2003 | Yeh | 248/287.1 |
| 2005/0189458 | A1 * | 9/2005 | Avinger | 248/301 |
| 2007/0001088 | A1 * | 1/2007 | Bowman | 248/690 |
| 2007/0205346 | A1 * | 9/2007 | Jackson et al. | 248/307 |

* cited by examiner

*Primary Examiner* — A. Joseph Wujciak, III
(74) *Attorney, Agent, or Firm* — Pearne & Gordon LLP

(57) ABSTRACT

An adjustable hanger device includes an adjustable mounting bracket that may be sized for mounting the hanger to support members of various dimensions. The hanger device has a composite structure including both metallic and polymeric components. The mounting bracket is formed of primarily metallic components to provide adequate hang strength, and a thin profile for use in so-called over-the-door hanger devices supported on the top edge of a door below the lintel or frame member when the door is in the closed position.

20 Claims, 6 Drawing Sheets

ADJUSTABLE HANGER DEVICE

FIELD OF INVENTION

The present invention relates generally to a hanger device and, more particularly, to a hanger device including an adjustable mounting bracket that may be sized for mounting to structural support members of various dimensions. The hanger device may be formed entirely of metallic components or it may be formed as a composite structure including both metallic and polymeric components.

The hanger device is illustrated herein with particular reference to a so-called over-the-door hanger constructed for hang mounting over the top edge of a door to support a hook, plural hooks, a hanger holder, a hook rack or a like utility device for supporting clothing or other articles. As described below, the door hanger includes a single hook.

BACKGROUND OF THE INVENTION

Over-the-door hangers formed entirely of plastic as shown in U.S. Design Pat. No. D445,669 are known. Such hangers may provide adequate hang strength, but they are not adjustable to permit mounting to doors of various thickness dimensions.

Similarly, over-the-door hangers of rod-like construction are shown in U.S. Pat. No. 6,267,257. The rod-like construction may not provide adequate lateral stability and may tend to mar adjacent finished surfaces. In the patent, the free ends of the rod adjacent the door surface are provided with rubber knobs to prevent damage to the door.

U.S. Pat. No. 6,302,365 discloses door hanger devices including hooks on both sides of the door. The hangers are formed of flat components to enhance lateral stability.

U.S. Pat. Nos. 6,749,165 and 6,814,335 disclose an over the door hanger having a U-shape hanger for mounting to a top edge of a door and a downwardly extending support portion extending to a thermoplastic hook. The support portion and the hook are injection molded together with a vertical support member embedded therein.

A hanging cup holder having a mounting arrangement of adjustable width is disclosed in U.S. Pat. No. 4,984,722. The extruded construction includes engaging serrations and grooves that enable adjustment of the mounting width. Adjustable width mounting constructions are also disclosed in U.S. Pat. Nos. 4,872,224, 5,783,319 and 5,803,422.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a hanger device includes an adjustable bracket having a longitudinal or mounting dimension that may be varied to accommodate support structures of different dimensions. The adjustable bracket includes a bridging element or portion arranged to be supported by and horizontally extend along a top side or edge of a door.

In accordance with another aspect of the present invention, the adjustable bracket is formed of metallic and polymer components that provide desired strength and size characteristics as well as an aesthetically pleasing appearance that also protects finished door surfaces. Accordingly, the hanger may be used in connection with typical residential door constructions with a reduced risk of damage to the door finish.

The bridging portion of the hanger has engaging members formed of sheet metal stock including a flat strip portion telescopically received within a generally flat channel. The metal materials may be selected to provide tensile strength properties that are an order of magnitude greater than those of typical moldable plastic materials. Accordingly, the engaging members dimensions are substantially less than would be required if corresponding strengths were to be provided with a plastic.

The hanger engaging members may also include polymer components for protecting the door finish and/or enabling the utility element to be economically formed by molding directly to the engaging member. Useful polymers include natural and synthetic materials that can be molded and are particularly exemplified by thermoplastics and thermoplastic elastomers.

BRIEF DESCRIPTION OF THE DRAWINGS

The foregoing and other aspects of the present invention will become apparent to those skilled in the art to which the present invention relates upon reading the following description with reference to the accompanying drawings, in which:

FIG. 6 is a perspective view similar to

FIG. 5 showing the top side of the metallic component of the support portion of the hanger device;

DETAILED DESCRIPTION OF THE EXAMPLE EMBODIMENTS AND DRAWINGS

Figure 1:
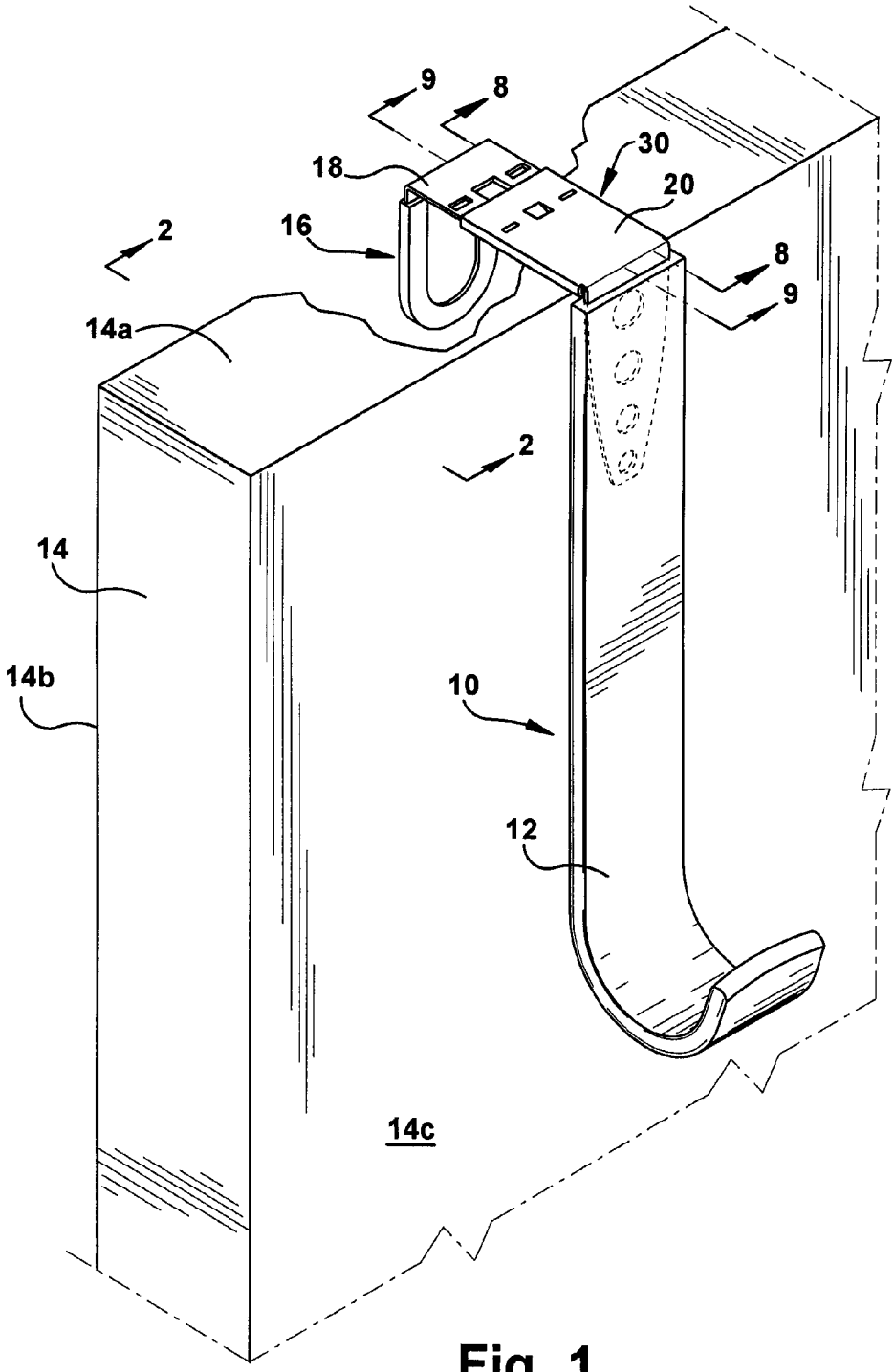
FIG. 1 is a fragmentary perspective view showing a hanger device including an adjustable mounting bracket mounted to a door in accordance with the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Figure 2:
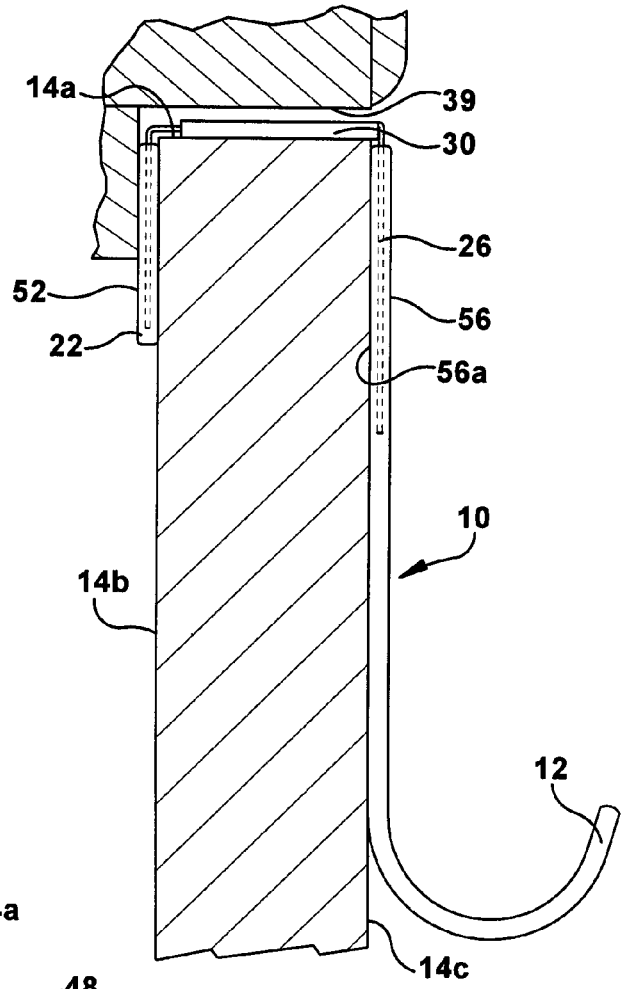
FIG. 2 is a fragmentary sectional view taken along the line 2-2 in FIG. 1 showing the hanger device mounted to the door in a closed position within a door frame.
Figure 3:
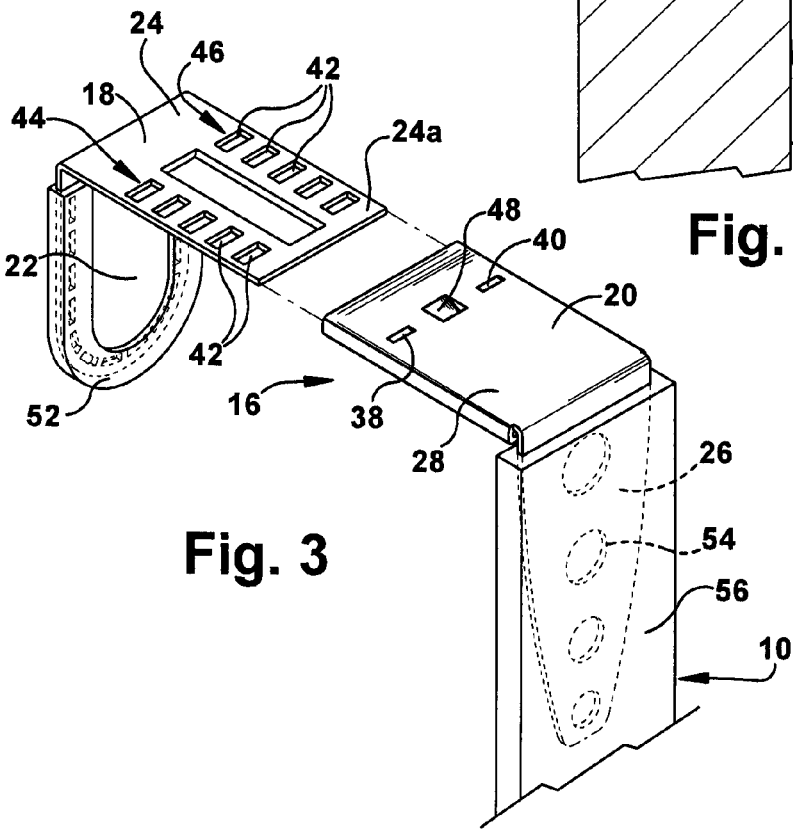
FIG. 3 is a fragmentary exploded perspective view on an enlarged-scale showing the adjustable bracket mounting portion separated from the support portion of the hanger device.

Turning to FIGS. 1 to 3, an over-the-door hanger 10 including a J-shape hook or utility member 12 is shown. The hanger is mounted to a structural support such as door 14 so that the J-shape hook 12 may be used to support an article of clothing (not shown) such as a shirt, pants, hat or coat and/or a clothes hanger for such an article of clothing.

The hanger 10 includes an adjustable bracket 16 having a mounting portion 18 and a support portion 20. Each of the portions 18 and 20 has an L-shape. The mounting portion 18 includes a depending retention leg or retention element 22 and a horizontally extending engagement member 24. The support portion 20 has a depending carrier leg or carrier element 26 and a horizontally extending engagement member 28. The engagement member 24 is telescopically received in the engagement member 28 to form a bridging element or portion 30.

As illustrated, the door 14 includes a top side 14*a*, a back side 14*b* and a front side 14*c*. The back side 14*b* and the front side 14*c* are parallel. The hanger 10 is mounted to the door with the bridging element or portion 30 extending along and supported by the top side 14*a* of the door 14 as shown in FIGS. 1 and 2. The retention leg 22 extends along and engages the back side 14*b* of the door and the carrier leg 26 extends along and engages the front side 14*c* of the door. The hanger may be mounted on the door 14 in an opposite front and back door side orientation to position the legs 22 and 26 adjacent the other sides of the door.

Figure 4:
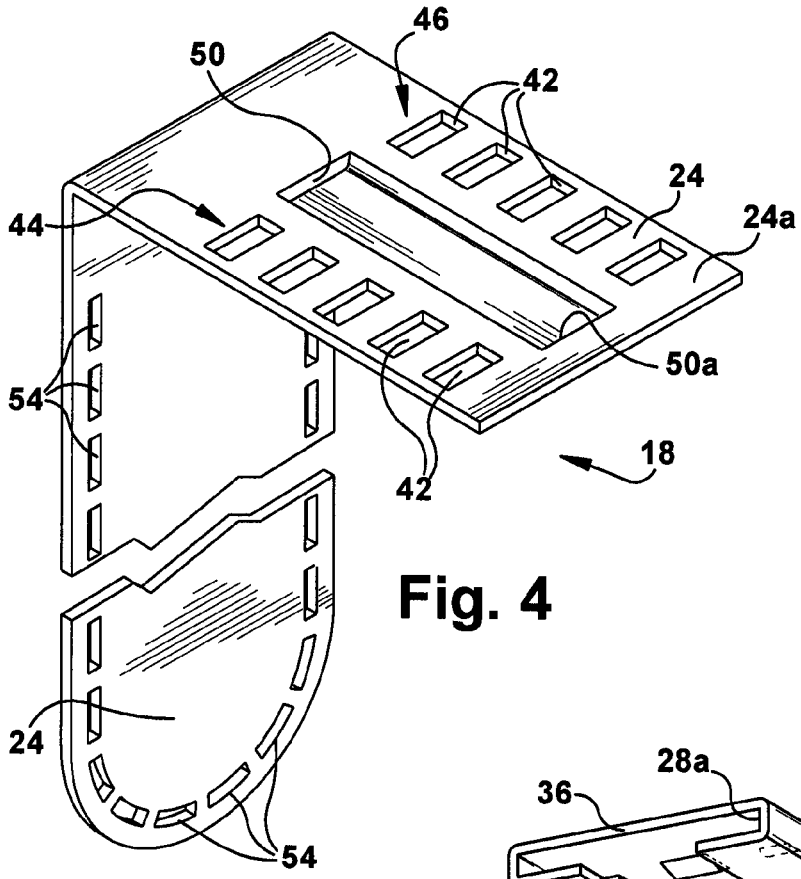
FIG. 4 is a perspective view showing the metallic component of the mounting portion of the hanger device.
Figure 5:
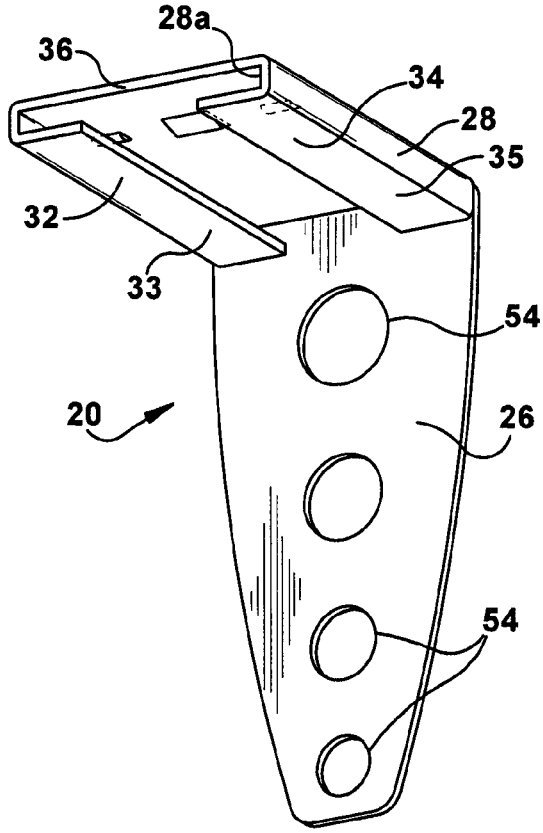
FIG. 5 is a perspective view showing the underside of the metallic component of the support portion.

The mounting portion 18 may be formed of flat sheet metal stock that has been bent to an L-shape with the retention leg 22 extending to the engagement member 24. The engagement member 24 includes a flat strip 24*a* of generally rectangular configuration and uniform thickness provided at the proximal end of the member as best shown in FIG. 4.

Figure 6:
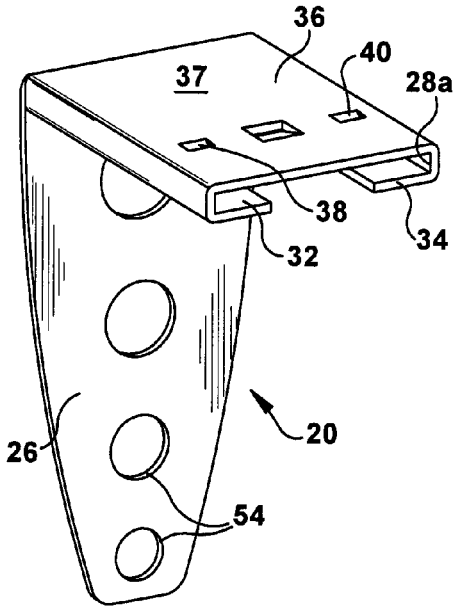

The support portion 20 may also be formed of flat sheet stock metal with the carrier leg 26 extending to the engagement member 28. The member 28 is bent or shaped to provide a channel 28*a*. The channel 28*a* has flat, downwardly-opening C-shape formed by a pair of spaced, laterally inwardly bent flanges 32 and 34. The flanges 32, 34 are connected by a channel wall 36 as best shown in FIGS. 6 and 7.

The flanges 32 and 34 respectively include co-planar lower surfaces 33 and 35, and the wall 36 has a planar upper or top surface 37. The lower surfaces 33 and 35 extend in a plane that is parallel to the plane of the top surface 37. The lower surfaces 33 and 35 engage the top side 14*a* of the door 14.

Figure 7:
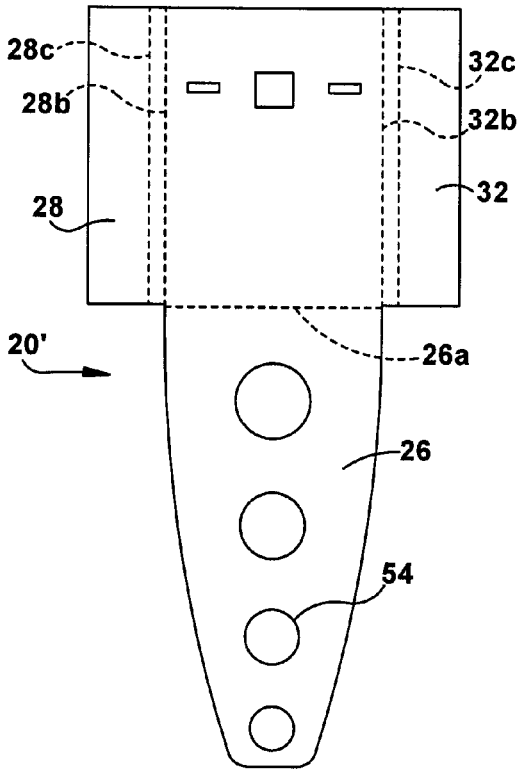
FIG. 7 is a plan view of a metal blank prior to bending to form the metallic component of the support portion.
Figure 8:
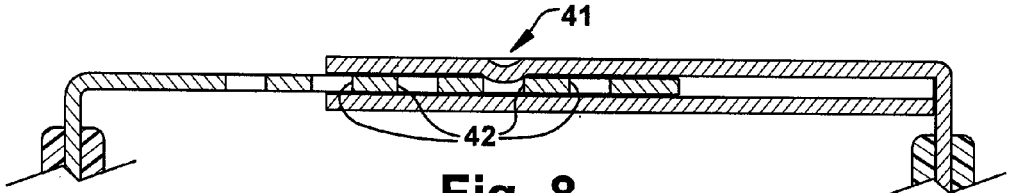
FIG. 8 is a sectional view taken along the line 8-8 in FIG. 1 showing a detent for fixing the relative positions of the mounting and support portions of the adjustable bracket.

Referring to FIG. 7, the proximal end of the support portion 20 is shown prior to being shaped to form the channel 28*a*. To that end, the carrier leg 26 extends to a laterally wider portion of a metal blank 20'. The metal blank 20' is bent into the plane of the figure along fold lines 28*b*, 32*b* and then laterally inwardly along the fold lines 28*c* and 32*c* to form the channel 28*a* as shown in FIGS. 6 and 7. The support portion is completed by bending along fold line 26*a* to dispose the carrier leg 26 at a right angle with respect to the engagement member 28. As explained below, it is also possible to dispose the leg 26 at a slight acute angle relative to the engagement member 28.

The metallic components of the portions 18 and 20 may be formed of any suitable metal, such as series 200 or 300 stainless steel. The flat steel stock may have a thickness of from about 0.020" to 0.050", and adequate tensile strength and hang weight loads are achieved with stock of about 0.030" thickness. The width of the flat strip 24*a* may be less than an inch, e.g., about 0.75". The channel 28*a* is sized to receive the flat strip 24*a* with a close sliding fit to provide a laterally stable connection with little, if any, vertical or lateral play between the engaged members.

The thickness of the channel 28*a* is sized to be received with clearance within the space between the top side 14*a* of the door 14 and the adjacent door frame member or lintel 39 as shown in FIG. 2. The bridging portion 30 has a thickness of less than 5⁄32", and typical thicknesses may be in the order of about 1⁄8" or less.

The use of the indicated materials, thicknesses and sizes has enabled hanging loads of up to 40 pounds, for example, with acceptable safety margins. These loads may be increased by variation of the dimensions of the hanger device.

The extent of the telescoping engagement of the members 24 and 28 may be varied to provide the bridging portion 30 with an incrementally adjustable longitudinal dimension or extent in the horizontal direction. To that end, the members 24 and 28 are provided with a detent 41 for releasably securing the members 24 and 28 together in an overlying longitudinally fixed position.

The detent 41 includes a pair of laterally spaced projections or bumps 38 and 40 extending downwardly from the member 28 for receipt in rectangular shaped openings 42 in the member 24. The openings 42 are arranged in laterally spaced columns 44 and 46, respectively aligned with the projections 38 and 40. The openings 42 are longitudinally spaced at uniform intervals along at least a portion of the length of the member 24. Accordingly, the incremental longitudinal adjustment of the horizontal length of the bridging portion 30 corresponds with the longitudinal spacing of the openings 42.

The projections 38, 40 and the openings 42 have generally rectangular shapes and peripheral surfaces that closely fit together. The projections and openings thereby provide associated, substantially planar, peripheral surfaces engaging in both the longitudinal and lateral directions. The relative positions of the engagement members 24 and 28 are thereby securely fixed by the detent 41 in the lock position. Of course, further stability is provided by the engagement of associated pairs of projections and openings at laterally spaced locations.

The horizontal length of the bridging portion 30 may be adjusted from an inch or less up to several inches. For residential applications, the bridging portion 30 dimension may varied about 1.25" to about 2.50" to accommodate most interior door thicknesses. It is advantageous to form the members 24 and 28 of thin metal stock in order to achieve the desired flexibility and adequate hang strength while maintaining a relatively thin overall construction easily received between the top side of the door and door lintel or molding.

The vertical play of the member 24 engaged within the channel 28*a* in combination with the flexibility of the members is sufficient to allow for engagement and disengagement of the detent 41 by hand manipulation. That is, the detent 41 may be moved from a lock position with the projections 38, 40 received in openings 42 to a release position with the projections disengaged from the openings. In this manner, the horizontal dimension of the bridging portion 30 and the engagement of the member 24 with the member 28 may be adjusted by pushing together or pulling apart the portions 18 and 20 by hand.

Figure 9:
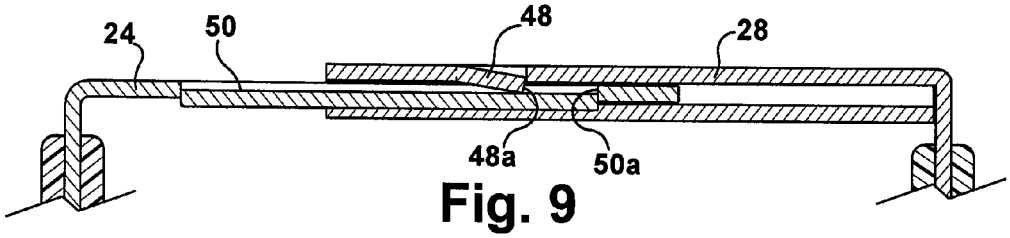
FIG. 9 is a sectional view taken along the line 9-9 in FIG. 1 showing a stop for inhibiting the disengagement of the mounting and support portions of the adjustable bracket.

The complete disengagement of the members 24 and 28 is inhibited by a stop tab 48 as best shown in FIG. 9. The stop tab 48 projects downwardly from the member 28 into a longitudinally extending recess 50 in the upper surface of the engagement member 24. The stop tab 48 includes a tab end 48*a* that abuts a forward end 50*a* of the recess 50 as the members 24 and 28 are longitudinally or horizontally pulled apart as shown in FIG. 9.

The retention leg 22 includes a cushion 52 adjacent its distal end for engagement with the back side 14*b* of the door. The cushion 52 is sized to space the metallic portions of the leg from the finished door surface.

The cushion 52 may be formed of a thermoplastic material or a thermoplastic rubber or elastomer material having suitable compressibility and coefficient of friction. For example, thermoplastic rubber or elastomer materials include materials such as styrenic block copolymers (TPE-S), thermoplastic polyolefins (TPE-O or TPO), thermoplastic vulcanisates (TPE-V or TPV), thermoplastic polyurethanes (TPE-U or TPU), thermoplastic copolyesters (TPE-E or COPE or TEEE), melt processable rubber (MPR) and thermoplastic polyether block amides (TPE-A). Styrene block copolymers have been found to provide the desired physical properties and may be over molded to the metal component of the retention leg 22. To that end, the retention leg 22 is provided with openings 54 through which the elastomeric material extends to form a secure attachment during molding.

The use of thermoplastic rubber or elastomer material enables a wide selection of softness or hardness characteristics. Thermoplastic rubbers may be formulated with softness to hardness values ranging from gel like at 20 Shore OO up to 90 Shore A, and even harder values on the Shore D scale. Preferably, the softer materials enable a higher coefficient of friction to inhibit sliding movement of the retention leg 22 along the surface of the back side 14*b* of the door 14 and unwanted pivotal movement of the hanger 10. Softer materials also tend to better avoid marring of the door.

The metallic and plastic components of the retention leg 22 cooperate to provide the desired strength, compressibility and friction properties. With regard to the latter properties, the cushion 52 is sufficiently compressible to accommodate slight differences between the horizontal length of the bridging portion 30 and the top side 14*a* of the door 14. That is, if the detent 41 is not adjustable to exactly conform the length of the bridging portion 30 to the dimension of the top side 14*a*, the cushion 52 may slightly compress to allow for the excess door thickness.

The carrier leg 26 includes a thermoplastic portion 56 provided by an integral extension of the thermoplastic material forming the J-shape hook 12. The thermoplastic portion 56 has a surface 56*a* (FIG. 2) which engages the front side 14*c* of the door 14. The connection between the thermoplastic portion 56 and the carrier leg 26 is enhanced by holes or molding openings 54 through which the thermoplastic material is over molded as the J-shape hook is formed.

The thermoplastic used to form the J-shape hook 12 may comprise any of the known members of the moldable thermoplastics such as polyamide, polybutadiene, polycarbonate, polyethylene, polyester, polyolefin, polypropylene, and polyurethane. Preferred plastics include crystalline thermoplastics such as polycarbonates, styrene acrylonitrile (SAN) and ABS have been found to provide suitably high-strength and durable utility elements.

As noted above, the engagement member 28 extends at a right angle relative to the carrier leg 26. Thus, the legs 22 and 26 are parallel. On the other hand, an acute angle may be provided between the plane of the lower surfaces 33 and 35 of the bridging portion 30 and the plane of the surface 56*a*. Alternatively, an acute angle may be formed between the engagement member 24 and the retention leg 22. In either case, the legs 22 and 26 are not parallel and extend toward each other at a slight intersecting angle.

If the legs 22 and 26 of the adjustable bracket 16 are not parallel, but form a slight intersecting angle, the legs will be forced slightly apart by engagement with the parallel sides 14*b* and 14*c* of the door 14. This will flex the bridging portion 30 and resiliently compress the cushion 52 which will cooperatively bias the detent 41 into its engaged position. That is, the projections 38 and 40 will be biased into the associated openings 42 to more securely fix the relative positions of the portions 18 and 20.

Figure 10:
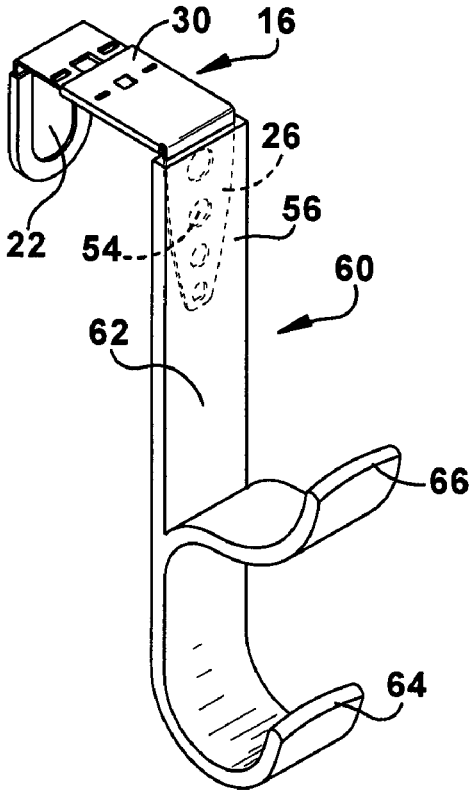
FIG. 10 is a perspective view of a hat and coat hook incorporating the adjustable mounting bracket in accordance with a second embodiment of the invention.
Figure 11:
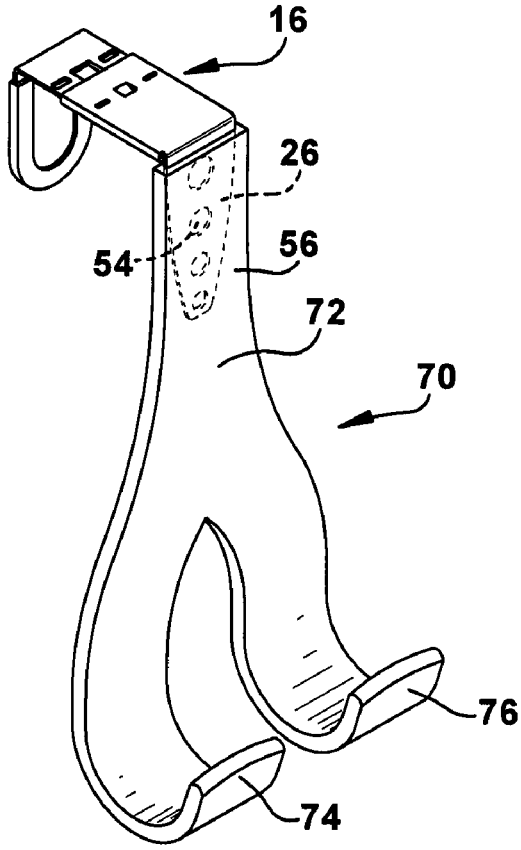
FIG. 11 is a perspective view of a double hook incorporating the adjustable mounting bracket in accordance with a third embodiment of the invention.

Referring to FIGS. 10 and 11, additional embodiments of hanger devices in accordance with the invention are shown. For convenience, corresponding elements are identified with the same reference numerals as used in connection with the first embodiment.

Referring to FIG. 10, a hangar device 60 comprising a hat and coat hook or utility element 62 is shown. As in the first embodiment, the adjustable bracket 16 includes retention leg 22 connected by bridging portion 30 to the carrier leg 26. The carrier leg 26 is over molded to the hook or utility element 62. The hook 62 includes a lower coat hook 64 and a vertically aligned upper hat hook 66. As in the first embodiment, the adjustable bracket 16 is primarily formed of metal and the hook 62 is formed of a moldable plastic such as polycarbonate.

Referring to FIG. 11, a hanger device 70 includes a plural hook utility element in the form of a double hook 72 supported by the carrier leg 26 of the adjustable bracket 16. The hook 72 includes laterally aligned and horizontally spaced hooks 74 and 76.

In each of the hanger devices 10, 60 and 70, the primary load bearing components of the adjustable bracket 16 are formed of metallic materials for strength and compactness. Polymeric components are provided for ease of manufacture and protection of engagement with the finished surfaces of the supporting structure. Further, the metallic components are formed of flat sheet metal stock and may be easily manufactured as by bending to the desired shapes. The polymeric components are formed of moldable materials that may be over molded to the metal components through molding openings to better secure the pieces and, as illustrated, to form a portion of the utility device itself.

Figure 12:
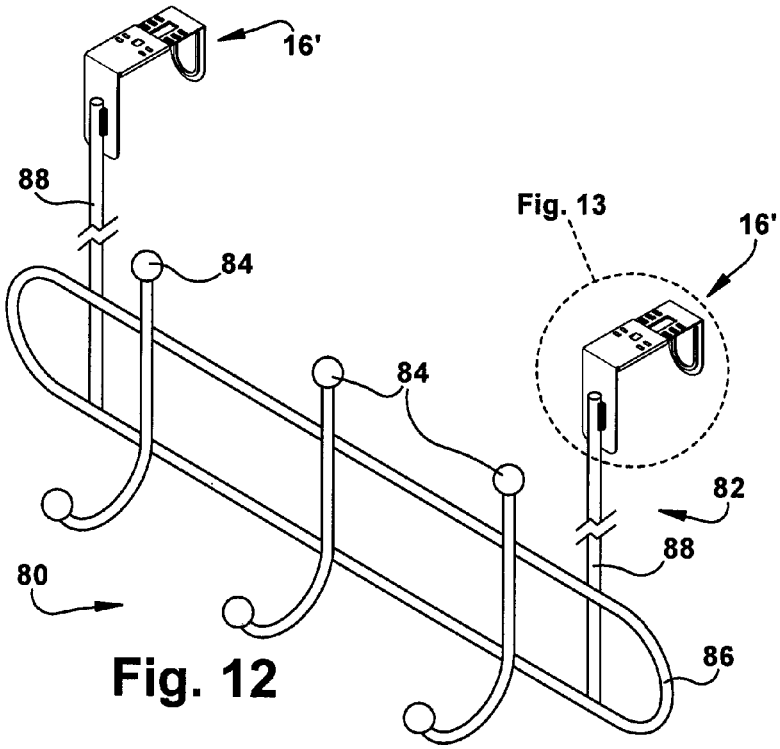
FIG. 12 is a perspective view of an over-the-door hook rack incorporating a pair of modified adjustable mounting brackets in accordance with a fourth embodiment of the invention.
Figure 13:
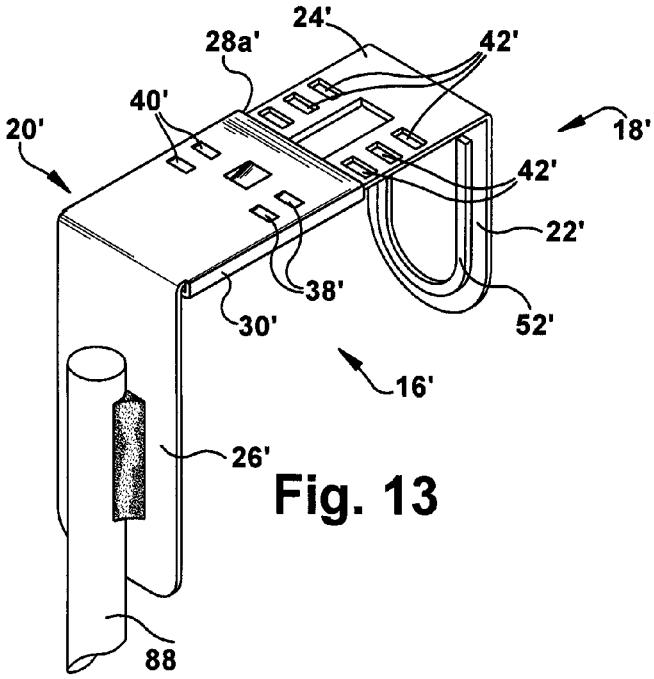
FIG. 13 is a fragmentary perspective view, on an enlarged scale, taken along the line 13 in FIG. 12.

Referring to FIGS. 12 and 13, a hanger device 80 includes an over-the-door hook rack or utility element 82 connected to a pair of identical adjustable brackets 16'. For convenience, corresponding elements are identified with the same reference numerals as used in connection with prior embodiments with the addition of a prime designation. The over-the-door rack 82 includes a plurality of J-shaped hooks 84 carried on an oval shaped track 86. The track 86 includes supports 88 that are each connected by welding to an associated bracket 16'. The brackets 16' may be mounted to a structural support member such as the top side 14*a* of a door 14.

The brackets 16' are identical in structure and function. Accordingly, only one of the brackets 16' is described below.

The bracket 16' has an all-metal construction including a mounting portion 18' and a support portion 20'. As in prior embodiments, the portions 18' and 20' each have an L-shape. The mounting portion 18' includes a depending retention leg or retention element 22' and a horizontally extending engagement member 24'. The support portion 20' has a depending carrier leg or carrier element 26' and a horizontally extending engagement member 28'. As in prior embodiments, the engagement member 24' is telescopically received in the engagement number 28' to form a bridging element or portion 30'.

The retention leg 22' is adapted to extend along and engage the backside 14*b* of the door 14 and the carrier leg 26' is adapted to extend along and engage the front side 14*c* of the door.

The mounting portion 18' may once again be formed of flat sheet metal stock that has been bent to an L-shape with the retention leg 22' extending to the engagement member 24'. The engagement member 24' is a flat strip shape 24*a'* as in prior embodiments.

The support portion 20' may also be formed of flat sheet stock metal with a channel 28*a'* that is substantially identical to that in prior embodiments. However, in this embodiment, the detent 41' includes four downwardly extending projections or bump 38' and 40' for receipt in the rectangular shaped openings 42' in the member 24'. The increased number of projections 38', 40' engaged within the openings 42' provide additional lateral stability and increased longitudinal strength or resistance to the pulling apart of the portions 18' and 20'.

The retention leg 22' once again includes a cushion 52' adjacent its distal end for engagement with the backside 14*b* of the door. In this embodiment, the cushion 52' does not extend around the edge of the retention leg 22'. In this embodiment, the cushion 52' merely comprises a U-shape layer pad extending along each of the opposed faces of the leg 22' and connected through the openings 54'.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A hanger device for mounting a utility element to a structural support that includes a generally horizontal top side extending between first and second support sides, said hanger device including an adjustable bracket having a bridging element to be supported on said top side, said bridging element including a flat strip and an open channel that adjustably telescopically engage in a longitudinal first direction to provide said bridging element with a horizontal bridging dimension, said bridging element including a detent movable between a lock position for fixing the relative position of said flat strip and open channel and a release position for permitting relative movement of said flat strip and open channel to adjust said horizontal bridging dimension in said first direction, said detent including projections spaced in a lateral second direction transverse to said first direction on said open channel arranged to be received within openings laterally spaced in said second direction in said flat strip, said open channel having a top wall connecting depending side walls extending to in-turned channel flange walls, said separate projections being integrally formed in said channel top wall and extending perpendicularly away from said top wall into said open channel, said openings comprising spaced apertures having closed boundaries and being arranged in columns in said flat strip, said bridging element connecting a retention element arranged to depend downwardly along said first side of the structural support and a carrier element arranged to depend downwardly along said second side of the structural support, said retention element including a retention element polymeric portion for engaging said first side of said structural support, and said carrier element including a carrier element polymeric portion for engaging said second side of said structural support and for attachment of said utility element to said hanger.

2. The hanger device of claim 1, wherein said retention element and said carrier element are biased apart by said structural support to flex said bridging element and thereby bias said detent into said locking position.

3. The hanger device of claim 2, wherein said retention element polymeric portion is resiliently compressed when said retention element and said carrier element are biased apart by said structural support.

4. The hanger device of claim 1, wherein said open channel top wall has a generally flat planar shape and said projections comprise bumps integrally formed in said open channel top wall, said bumps having a polygonal cross-sectional shape in a plane parallel to said top wall, and said aperture boundaries have corresponding polygonal shapes to receive said bumps.

5. The hanger device of claim 1, wherein said projections comprise two projections laterally spaced in said second direction on said open channel top wall and said apertures are arranged in two columns laterally spaced in said second direction on said flat strip, each column including a plurality of said apertures spaced at uniform intervals in said first direction that correspond to the incremental adjustment of said horizontal bridging dimension.

6. The hanger device of claim 5, wherein said apertures boundaries have polygonal shapes and said projections include cross-sections having corresponding polygonal shapes, and said apertures and said projections include associated substantially planar peripheral surfaces that engage to resist relative lateral and longitudinal movement of said flat strip and open channel when said detent is in said lock position.

7. The hanger device of claim 5, wherein said open channel includes a projecting stop tab and said flat strip includes a recess having an end wall for abutting said stop tab and inhibiting disengagement of said flat strip and open channel.

8. The hanger device of claim 5, wherein said carrier element has at least one molding opening, and said carrier element polymeric portion is an integral extension of said utility element that is over molded to said carrier element through said molding opening.

9. The hanger device of claim 5, wherein said bridging dimension in said longitudinal first direction may be varied from about 1.25" to about 2.5", said flat strip and said open channel are each formed of sheet metal having a thickness of from about 0.020" to about 0.050" and said open channel has a thickness of less than about 5/32".

10. The hanger device of claim 1, wherein said retention element includes a first metal portion integrally forming said flat strip and said carrier element includes a second metal portion integrally forming said open channel.

11. A hanger device for mounting a utility element to a structural support that includes a generally horizontal top side extending between first and second structural support sides, said hanger device including an adjustable bracket having a mounting portion and a support portion, said mounting portion and said support portion respectively including engagement members that adjustably telescopically engage in a longitudinal first direction to form a bridging element arranged to be supported on said top side of the structural support and to provide said bridging element with a horizontal bridging dimension, said bridging element including a detent movable between a lock position for fixing the relative position of said first and second engagement members and a release position for permitting relative movement of said first and second engagement members to adjust said horizontal bridging dimension in said first direction, said detent including separate projections spaced in a lateral second direction transverse to said first direction on said second engagement member, said first engagement member including openings laterally spaced in said second direction for receiving said projections, said first engagement member including a flat strip and said second engagement member including an open channel for receiving said flat strip, said open channel having a top wall connecting depending side walls extending to in-turned channel flange walls, said separate projections being integrally formed in said channel top wall and extending perpendicularly away from said top wall into said open channel, said openings comprising spaced apertures having closed boundaries and being arranged in columns in said flat strip, said mounting portion engagement member also including a retention element arranged to depend downwardly along and flexibly engage said first side of the structural support, said support portion engagement member also including a carrier element arranged to depend downwardly along said second side of the structural support and to have said utility element affixed thereto.

12. The hanger device of claim 11, wherein said detent is incrementally adjustable to fix the extent of the telescopic engagement of said engagement members and the horizontal bridging dimension.

13. The hanger device of claim 12, wherein said bridging element is provided by integrally formed metal portions of said engagement members.

14. The hanger device of claim 13, wherein said detent includes two projections laterally spaced in said second direction on said top wall of said open channel and said apertures are arranged in two columns laterally spaced in said second direction on said flat strip, each column including a plurality of said openings spaced at uniform intervals in said first direction that correspond to the incremental adjustment of said horizontal bridging dimension.

15. The hanger device of claim 11, wherein said hanger device includes a second adjustable bracket and said utility element is an over-the-door device having first and second supports respectively connected to said first mentioned adjustable bracket and said second mentioned adjustable bracket.

16. The hanger of claim 15, wherein said retention element includes a retention element thermoplastic elastomer portion for engaging said first side of said structural support, said engagement members include metal portions forming said bridging element for engaging said top side of said structural support and said carrier element includes a carrier element thermoplastic portion for portion for attachment of a utility element.

17. The hanger device of claim 16, wherein said carrier element has at least one molding opening, and said carrier element thermoplastic portion is an integral extension of said utility element that is over molded to said carrier element through said molding opening.

18. The hanger device of claim 17, wherein said hanger device is an over-the-door hanger and said structural support is a door.

19. The hanger device of claim 18, wherein said bridging dimension may be varied from about 1.25" to about 2.50", said flat strip and said open channel are each formed of sheet metal having a thickness of from about 0.020" to about 0.050", and said open channel has a thickness of less than about 5/32".

20. A hanger device for mounting a utility element to a structural support that includes a generally horizontal top side extending between first and second structural support sides, said hanger device including an adjustable bracket having a mounting portion and a support portion, said mounting portion and said support portion respectively including a flat strip and a flat downwardly-opening C-shaped channel that adjustably telescopically engage in a longitudinal first direction to form a bridging element arranged to be supported on said top side of the structural support and to provide said bridging element with a horizontal bridging dimension extending in said first direction, a detent to adjustably fix the extent of engagement of said flat strip and flat channel, said detent being movable between a lock position for fixing the relative position of flat strip and flat channel and a release position for permitting relative movement of said flat channel and said flat strip to adjust said horizontal bridging dimension in said first direction, said detent including separate projections spaced in a lateral second direction transverse to said first direction on said flat channel for receipt within separate openings laterally spaced in said second direction in said flat strip, said flat channel having a top wall connecting depending side walls extending to in-turned channel flange walls, said separate projections being integrally formed in said channel top wall and extending perpendicularly away from said top wall into said open channel, said openings comprising spaced apertures having closed boundaries and being arranged in columns in said flat strip, said mounting portion engagement member also including a depending retention element having a polymeric portion, said retention element extending downwardly along and flexibly engaging said first side of the structural support with said polymeric portion of the retention element, said support portion engagement member also including a carrier element having a carrier element polymeric portion, said carrier element extending downwardly along said second side of the structural support with said carrier element polymeric portion engaging said second side of the structural support and integrally forming a part of said utility element.

* * * * *